US012397834B2

(12) United States Patent
Fernandes et al.

(10) Patent No.: US 12,397,834 B2
(45) Date of Patent: Aug. 26, 2025

(54) END OF TRAIN DEVICE WITH SELF-ALIGNMENT AND MOUNTING INTEGRITY MONITORING CAPABILITIES

(71) Applicant: Siemens Mobility, Inc., New York, NY (US)

(72) Inventors: Mario Fernandes, Jacksonville, FL (US); Harsh Piparsaniya, Maharashtra (IN)

(73) Assignee: Siemens Mobility, Inc., New York, NY (US)

( * ) Notice: Subject to any disclaimer, the term of this patent is extended or adjusted under 35 U.S.C. 154(b) by 843 days.

(21) Appl. No.: 17/646,332

(22) Filed: Dec. 29, 2021

(65) Prior Publication Data

US 2023/0202538 A1 Jun. 29, 2023

(51) Int. Cl.
*B61L 15/00* (2006.01)

(52) U.S. Cl.
CPC ..... *B61L 15/0054* (2013.01); *B61L 15/0027* (2013.01); *B61L 15/0081* (2013.01)

(58) Field of Classification Search
CPC ..... B61L 15/0054; B61L 15/0027; B61L 15/0081
See application file for complete search history.

(56) References Cited

U.S. PATENT DOCUMENTS

| | | | | |
|---|---|---|---|---|
| 6,865,454 | B2 * | 3/2005 | Kane | B61L 15/0062 701/19 |
| 8,696,071 | B2 * | 4/2014 | Root | B60T 13/662 303/47 |
| 10,836,411 | B2 * | 11/2020 | Kernwein | B61L 25/021 |
| 11,097,754 | B2 * | 8/2021 | Graham | B60T 13/665 |
| 12,022,375 | B2 * | 6/2024 | Edmondson | H04L 45/021 |
| 2020/0207385 | A1 * | 7/2020 | Kernwein | B61L 15/0027 |
| 2020/0247439 | A1 * | 8/2020 | Graham | B61L 15/0036 |
| 2021/0229715 | A1 * | 7/2021 | Abrosimov | B61L 15/0072 |
| 2022/0097743 | A1 * | 3/2022 | Bolte | B60T 13/665 |
| 2022/0194443 | A1 * | 6/2022 | Covari | H02J 7/14 |

* cited by examiner

*Primary Examiner* — Jason C Smith

(57) ABSTRACT

An end of train device (EOT) suitable of use on a railway vehicle includes a mounting unit for installation on a car of a railway vehicle, a position sensor configured to detect vertical alignment and orientation during the installation, and a feedback mechanism configured to provide feedback during the installation with respect to the vertical alignment and orientation. Further, a monitoring and communications system and a method for monitoring mounting integrity of an EOT are described.

15 Claims, 4 Drawing Sheets

END OF TRAIN DEVICE WITH SELF-ALIGNMENT AND MOUNTING INTEGRITY MONITORING CAPABILITIES

BACKGROUND

1. Field

Aspects of the present disclosure generally relate to an end of train device, specifically an end of train device with self-alignment and mounting integrity monitoring capabilities.

2. Description of the Related Art

Within the railway industry, an end of train device, herein also referred to as EOT, is an electronic device which performs several functions, some of which are required by regulations of the Federal Railroad Administration (FRA). The EOT is typically attached at a rear of a last car on a railway vehicle or train, often to an unused coupling on an end of the last car opposite a head of the train.

EOTs were originally designed to perform some of the functions previously performed by train personnel located in the caboose, thereby allowing trains to operate without a caboose and with a reduced number of train personnel. For example, an EOT can monitor air pressure in the air brake pipe and transmit this information to a head of train device, herein also referred to as HOT. A HOT is located at a first car on the train, for example a locomotive, opposite the EOT. Further, EOTs also often include an end-of-train marker light to alert trailing trains on the same track of the presence of the end of the train. Two-way EOTs can accept commands from the HOT, for example to open a valve to release pressure in the air brake pipe so that the train's air brakes activate to stop the train in an emergency. EOTs and HOTs can comprise many other components and/or functions.

EOTs are often improperly mounted to the car coupling, leading to the EOT being out of the required alignment with the railroad track. Also, improper attachment of the EOT to the coupling or to the train brake pipe can lead to problems such as the EOT hose getting disconnected or the EOT working itself loose and falling off the coupling. In both cases, an undesirable emergency brake application will likely result, which translates into train delays and possibly derailments.

SUMMARY

Briefly described, aspects of the present disclosure generally relate to an EOT, specifically an EOT with self-alignment and mounting integrity monitoring capabilities. The EOT is suitable for railway vehicles such as freight trains and passenger trains. Further aspects relate to a monitoring and communications system and a method of monitoring mounting integrity of an EOT.

A first aspect of the present disclosure provides an end of train device (EOT) suitable of use on a railway vehicle comprising: a mounting unit for installation on a car of a railway vehicle, a position sensor configured to detect vertical alignment and orientation during the installation, and a feedback mechanism configured to provide feedback during the installation with respect to the vertical alignment and orientation.

A second aspect of the present disclosure provides a monitoring and communications system comprising an end of train device (EOT) coupled to a car of a railway vehicle, a head of train device (HOT), a communications network interfacing with EOT and HOT, wherein the EOT comprises a position sensor configured to detect vertical alignment and orientation of the EOT, and a feedback mechanism configured to provide feedback with respect to the vertical alignment and orientation, and wherein the EOT is configured to transmit the feedback with respect to the vertical alignment and orientation to the HOT.

A third aspect of the present disclosure provides a method of monitoring mounting integrity of an end of train device (EOT), the method comprising: monitoring, by a position sensor, a position of an EOT coupled to a car of a railway vehicle, the position sensor being integrated into the EOT, monitoring, by an imaging device, a brake pipe connection between a brake hose of the railway vehicle and a hose of the EOT, the imaging device being integrated into the EOT, identifying an incorrect position or a faulty brake pipe connection, and transmitting, by a feedback mechanism of the EOT, feedback including the incorrect position or the faulty brake pipe connection to another electronic train device.

DETAILED DESCRIPTION

To facilitate an understanding of embodiments, principles, and features of the present disclosure, they are explained hereinafter with reference to implementation in illustrative embodiments. In particular, they are described in the context of electronic train devices, such as for example EOTs, in connection with a railway vehicle.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

Figure 1:
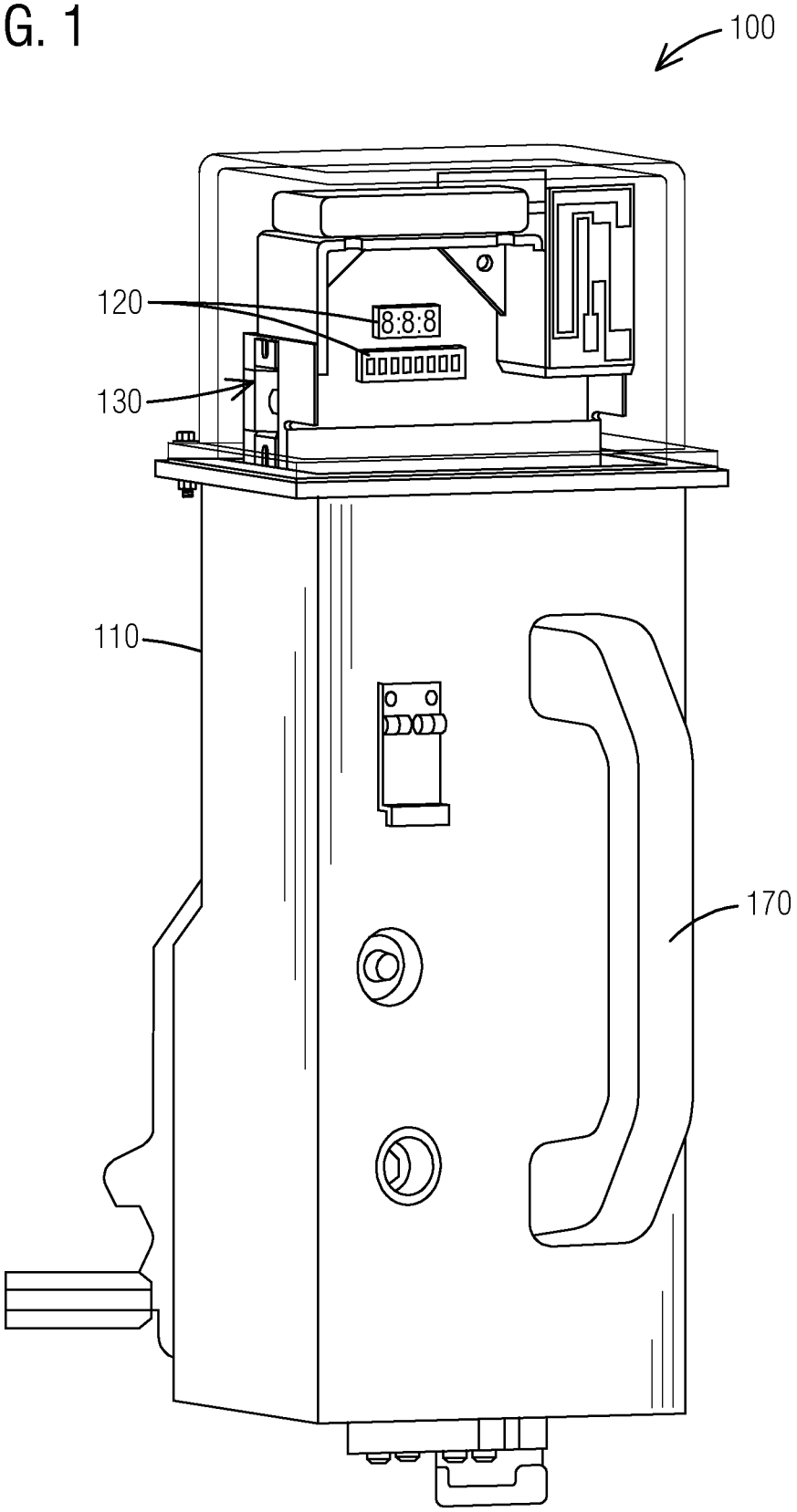
FIG. 1 illustrates a schematic of an end of train device (EOT) in accordance with an exemplary embodiment of the present disclosure.

FIG. 1 illustrates a schematic of a perspective view of an EOT 100 in accordance with an exemplary embodiment of the present disclosure. The EOT 100 is suitable of use on a railway vehicle located on a last train car of the railway vehicle, for example a freight train. The EOT 100 comprises an enclosure 110, and a plurality of components, such as electronic components, positioned inside the enclosure 110. For example, one or more displays 120 are positioned inside the enclosure 110. The one or more displays 120 display information and/or data provided by the EOT 100. An important component of the EOT 100 is a high visibility marker light (HVM) 130 which is utilized to illuminate a rearward of the railway vehicle. The EOT 100 further comprises a coupling unit (not visible in FIG. 1), typically attached to the housing 110, which couples the EOT 100 to the last train car, for example a train car coupling.

Examples of other components of the EOT 100 include cell phone transceivers, systems for monitoring/controlling brake lines and pressure, communication systems for communicating with other units, such as for example HOTs etc. The EOT 100 further comprises a handle 170 attached to the housing 110 for handling such as installation and removal of the EOT 100 on/off a train car of a railway vehicle, in particular a last train car. It should be noted that one of ordinary skill in the art is familiar with structure, components and functions of different types of EOTs, and they will not be described in further detail herein.

A head of train device (HOT) can be integrated into locomotive cab electronics or can be a standalone or console mounted unit. When used with an EOT, the HOT provides the locomotive engineer with important information regarding operation of the train. These conditions include brake pipe pressure and various status conditions. The EOT transmits data via a telemetry link, for example radio-based telemetry, to the HOT in the locomotive.

As described earlier, EOTs are often improperly mounted to the car coupling, leading to the EOT being out of the required alignment with the railroad track. Also, improper attachment of the EOT to the coupling or to the train brake pipe can lead to problems such as the EOT hose getting disconnected or the EOT working itself loose and falling off the coupling. In both cases, an undesirable emergency brake application will likely result, which translates into train delays and possibly derailments.

Figure 2:
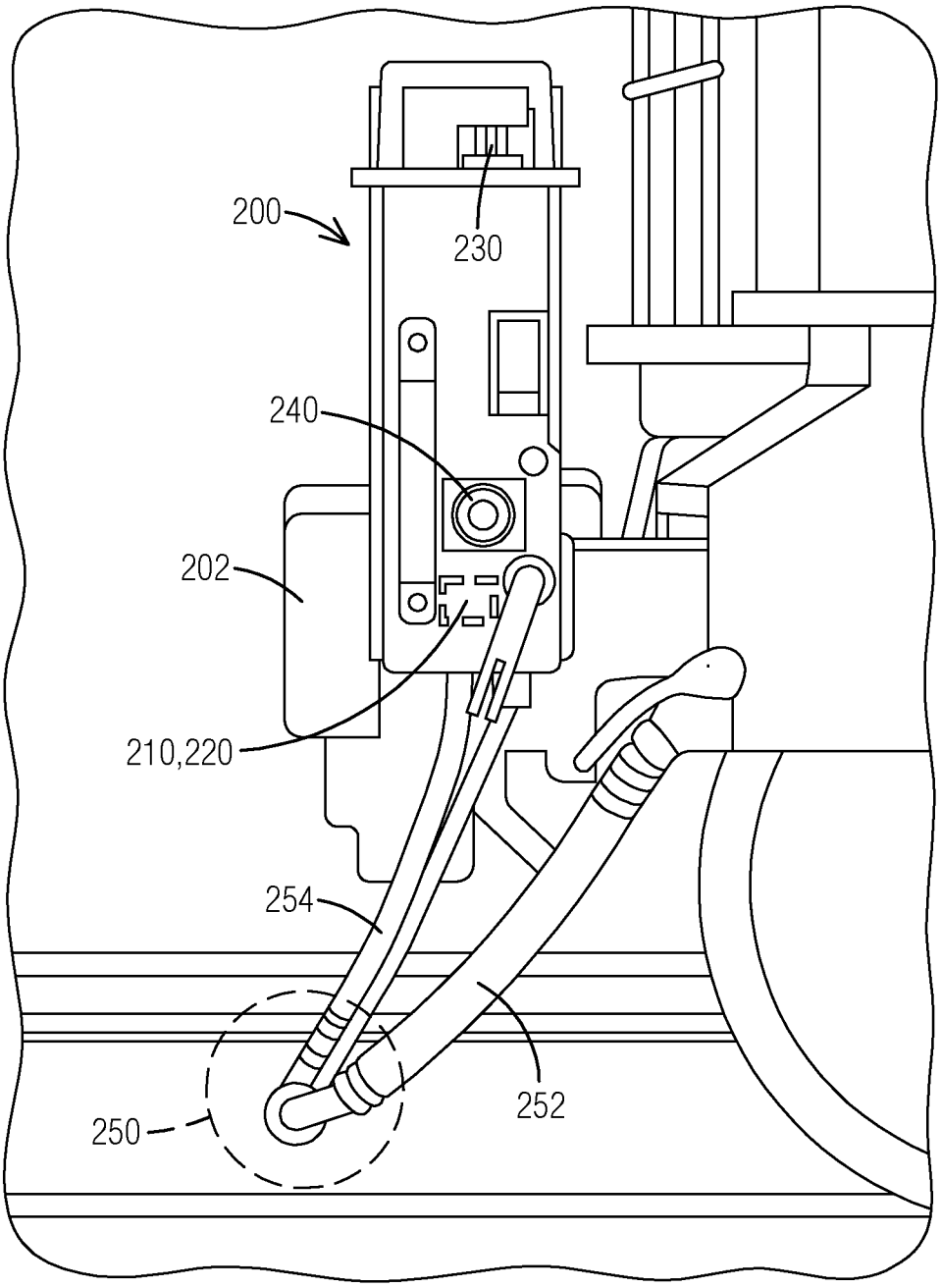
FIG. 2 illustrates an EOT attached to a coupling of a car of a railway vehicle in accordance with an exemplary embodiment of the present disclosure.

FIG. 2 illustrates an EOT attached to a coupling of a car of a railway vehicle in accordance with an exemplary embodiment of the present disclosure. EOT 200 may be configured as described for example with reference to FIG. 1. The EOT 200 is installed on a last car of railway vehicle via a mounting unit, typically coupled to an unused coupling 202 of the last car of the railway vehicle.

In an exemplary embodiment of the present disclosure, the EOT 200 comprises a position sensor 210 configured to detect vertical alignment and orientation of the EOT 200, for example during the installation of the EOT 200. It should be noted that the position sensor 210 is only shown schematically and in a suggestive manner. The position sensor 210 is integrated into the EOT 200. Further, it should be noted that the EOT 200 may comprise one or multiple position sensors 210.

Figure 3:
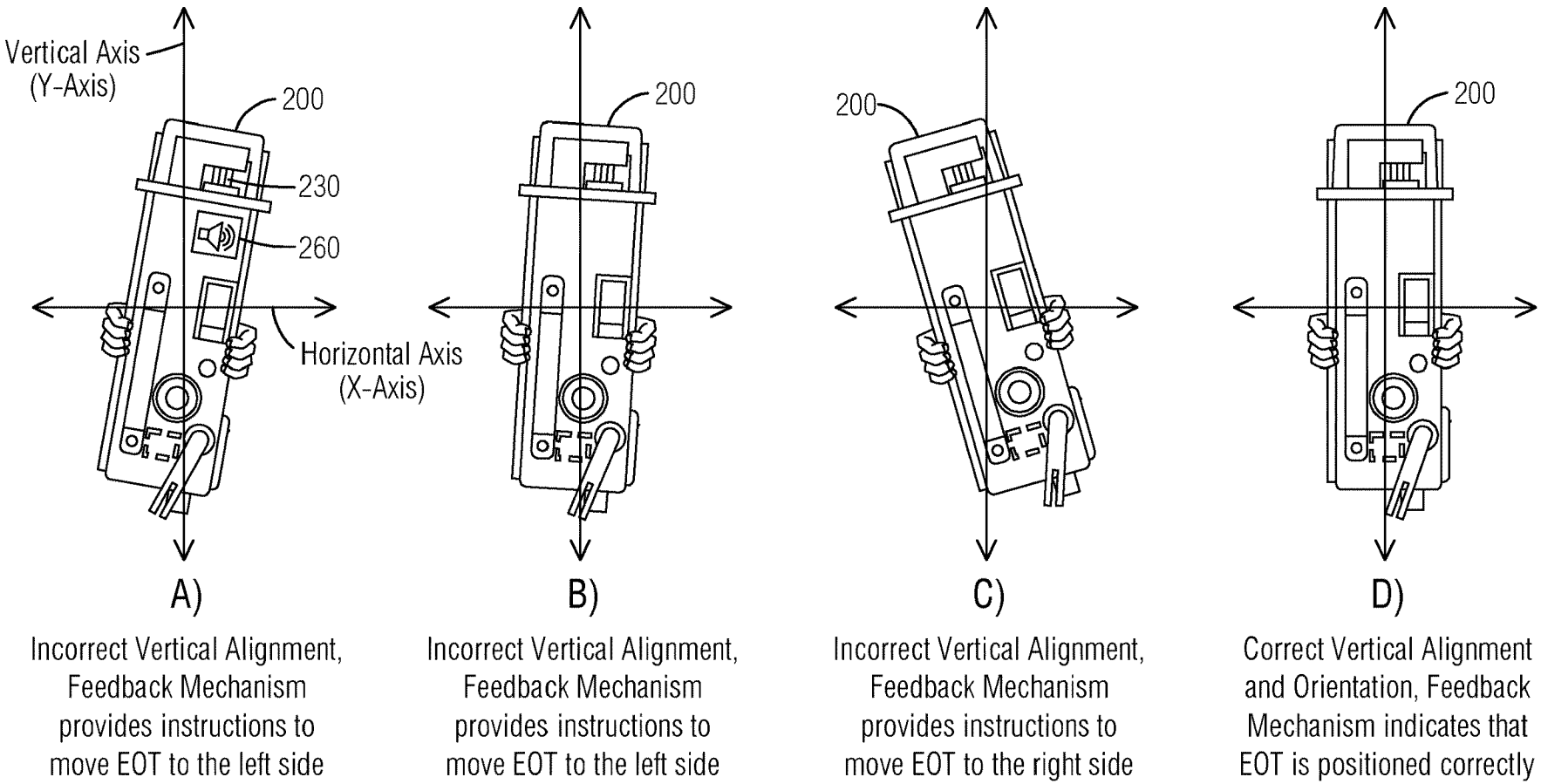
FIG. 3 illustrates various positions of an EOT during installation in accordance with an exemplary embodiment of the present disclosure.

Vertical alignment of the EOT 200 refers to an alignment according to a vertical axis, at a right angle to a horizontal axis or plane (see also FIG. 3). Orientation refers to correct angles, for example tilt angle, of the EOT 200 with respect to tracks the railway vehicle is travelling on.

The one or more position sensor(s) 210 is/are selected from an accelerometer, gyroscope, magnetometer (e. g. compass), a global positioning system (GPS) receiver or a global navigation satellite system (GNSS) receiver.

Further, the EOT comprises a feedback mechanism 220 configured to provide feedback during the installation with respect to the vertical alignment and orientation. Such feedback is provided and can be utilized for proper installation of the EOT 200. For example, feedback is provided to a person or user, for example train/railway personnel, installing the EOT 200, to support and ease the installation. The feedback mechanism 220 is integrated into the EOT 200 and only shown schematically and in a suggestive manner. In an example, the position sensor 210 and feedback mechanism 220 can be a combined unit, e. g. the feedback mechanism may be included with the sensor 210. In other words, the position sensor(s) 210 and feedback mechanism 220 provide an active alignment aid to the user when the EOT 200 is being mounted to the car coupling 202.

The feedback mechanism 220 is configured to provide visual feedback and/or audio (sound) feedback. Other types of feedback may be haptic feedback, for example application of vibrations or motions to the user/railway personnel. For example, one or more vibration units may be integrated into the EOT 200. If the EOT 200 is not aligned properly, for example during installation or re-adjustment later on, the user feels or experiences vibrations/vibratory motion, initiated by the vibration unit(s) of the EOT 200.

In an example, the feedback mechanism 220 is connected to a display 230 of the EOT 200, for displaying the visual feedback. The visual feedback may include information or data with respect to the vertical alignment and orientation of the EOT 200. In another example, the feedback mechanism 220 is connected to an audio output device for providing the audio feedback, the audio output device being integrated into the EOT. An example of an audio output device includes a speaker.

In another embodiment, the position sensor 210 is configured to monitor attitude including vertical alignment and orientation of the EOT 200 during operation of the railway vehicle, i. e. while the railway vehicle is travelling on railway tracks. This means that the position sensor 210 is configured to continuously monitor the attitude of the EOT 200, check for motion and acceleration signals that indicate that the EOT 200 may be wiggling and working itself loose from the coupling 202.

In another exemplary embodiment of the present disclosure, the EOT 200 comprises an imaging device 240 configured to monitor a brake pipe connection 250 between a brake hose 252 of the railway vehicle and a hose 254 of the EOT 200. The imaging device 240 may comprise a camera, e. g. video camera, for example a digital camera. It should be noted that the imaging device 240 is only shown schematically and in a suggestive manner. For the imaging device 240 to be able to monitor the brake pipe connection 250, the imaging device 240, e. g. video camera, is arranged to look toward the brake pipe connection 250. Thus, an angle/orientation of the imaging device 240 is such that the connection 250 can be monitored correctly. Further, the imaging device 240 is coupled to the feedback mechanism 220 configured to provide feedback with respect to the brake pipe connection 250.

Further, the feedback mechanism 220 is configured to transmit the feedback with respect to the vertical alignment, the orientation, and/or the brake pipe connection 250 to a head of train device (HOT). Specifically, the feedback mechanism 220 of the EOT 200 will transmit a diagnostic alarm message, for example to the HOT, when the brake pipe connection 250 is faulty or when the position/attitude of the EOT is incorrect. The HOT will then display the diagnostic alarm message, for example to a locomotive engineer, who can then initiate corrective measures.

FIG. 3 illustrates various positions of an EOT during installation in accordance with an exemplary embodiment of the present disclosure. As described herein, during installation of EOT 200, the position sensor(s) 210 in combination with the feedback mechanism 220, monitor and detect vertical alignment and orientation of the EOT 200 and provide feedback to the person installing the EOT 200.

FIG. 3 illustrates various positions A), B), C) and D) of the EOT 200 that may occur during installation. Positions A), B) and C) include incorrect positions, specifically incorrect vertical alignment of the EOT 200. With respect to positions A) and B), the position sensor 210 will detect that the EOT 200 requires movement to a left side toward vertical axis (Y-axis). Consequently, the feedback mechanism 210, for example via audio output device 260, e. g. speaker, will notify the installer to move the EOT 200 to the left side, for example via specific sound signals. In addition, or in the alternative, the display 230 may display information, such as message(s), to the installer to move the EOT 200 to the left side. With respect to position C), the installer will be notified to move the EOT 200 to the right side toward the vertical axis (Y-Axis). Position D) comprises correct vertical alignment and orientation of the EOT 200 and the feedback mechanism 220 will notify the installer that the EOT 200 is positioned correctly.

Figure 4:
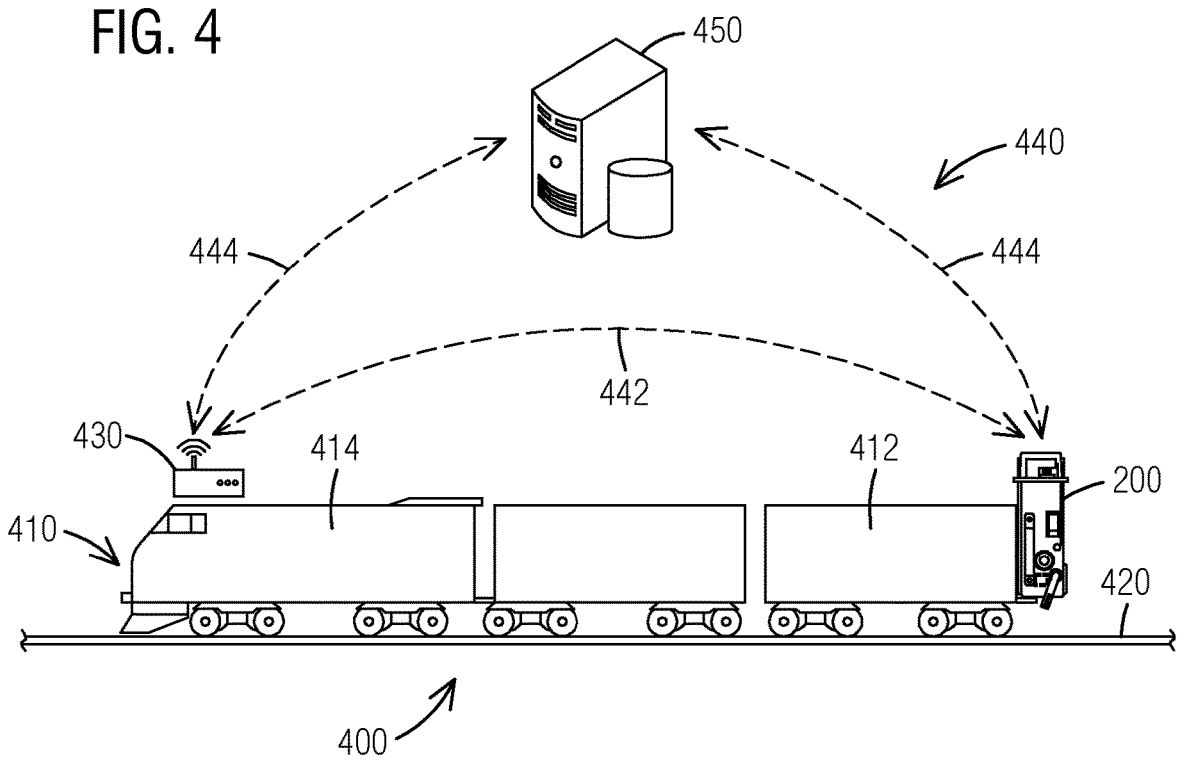
FIG. 4 illustrates a schematic of a monitoring and communications system in accordance with an exemplary embodiment of the present disclosure.

FIG. 4 illustrates a schematic of a monitoring and communications system in accordance with an exemplary embodiment of the present disclosure.

In an exemplary embodiment of the present disclosure, monitoring and communications system 400 comprises EOT 200 coupled to a last car 412 of a railway vehicle (train) 410, travelling on railway tracks 420. The system 400 comprises HOT 430, located on the other end of the train 410, for example in locomotive 414 of train 410. A communications network 440 interface with EOT 200 and HOT 430, and is adapted to transmit data, such as for example telemetry messages, between EOT 200 and HOT 430.

The EOT 200 and HOT 430 are in communication with each other, for example transmitting and/or receiving information, commands, or signals. A typical HOT 430 comprises several lights indicating telemetry status and rear end movement, along with a digital readout of brake line pressure from the EOT 200. The HOT 430 further includes means, for example a switch, for initiating an emergency brake application from the rear end. The HOT 430 can be built into the locomotive's 414 computer system and information is displayed on a computer screen. In an example, the HOT 430 can be integrated into a Positive Train Control (PTC) system of the railway vehicle 410, specifically in the locomotive 414.

The communications network 440 can be for direct or indirect communication between the different components. EOT 200 and HOT 430 can directly communicate via radio-telemetry messages, see link 442.

EOT 200 and HOT 430 may indirectly communicate, for example via a remote server 450 or remote base station, see links 444. Communication via remote server 450 or remote base station may be performed using wireless networks, such as for example wireless LAN (over Internet access point), cellular/mobile network(s) or other radio technology, such as for example via cellular V2X or via standard LTE (3G/4G/5G).

The EOT 200 can be configured as described for example with reference to FIG. 2 and comprises position sensor(s) 210 configured to detect vertical alignment and orientation of the EOT 200, and a feedback mechanism 220 configured to provide feedback with respect to the vertical alignment and orientation. The EOT 200 is configured to transmit the feedback with respect to the vertical alignment and orientation to the HOT 430.

Further, the EOT 200 further comprises an imaging device 240 for monitoring a brake pipe connection 250 between a brake hose 252 of the railway vehicle and a hose 254 of the EOT 200, wherein the imaging device 240 is coupled to the feedback mechanism 220 and configured to provide feedback with respect to the brake pipe connection 250 to the HOT 430.

As noted, the EOT 200 can be configured to transmit the feedback directly to the HOT 430 via a radio-based telemetry link. In another example, the EOT 200 can be configured to transmit the feedback indirectly to the HOT 430 via a remote server 450 or a remote base station.

In another exemplary embodiment of the present disclosure, the EOT 200 is configured to send feedback information, such as alignment/connection health information, to the remote server 450 for further processing. For example, the remote server 450 can be configured to broadcast the alignment/connection health information of the respective EOT 200 to other trains in the vicinity, specifically to EOTs and HOTs of nearby trains. Broadcasting the alignment/connection health information, in particular information that the EOT 200 is not properly aligned and/or connected, can be crucial. For example, if the brake hose connection of the EOT 200 is loose/disconnected, then the EOT 200 may not have a proper position of the high visibility marker light (HVM), see HVM 130 in FIG. 1, and the braking functionality may also be compromised. Sending such faulty connection/alignment information to the remote server 450, along with location information (GPS) of the EOT 200, then the remote server 450 can inform near-by trains about the EOT failure or EOT issues. Similarly, the EOT 200 may be configured to broadcast the alignment/connection health information as telemetry messages to other EOTs and/or HOTs of nearby trains. Broadcasting this information helps other trains to avoid collision, or unnecessary delays.

Figure 5:
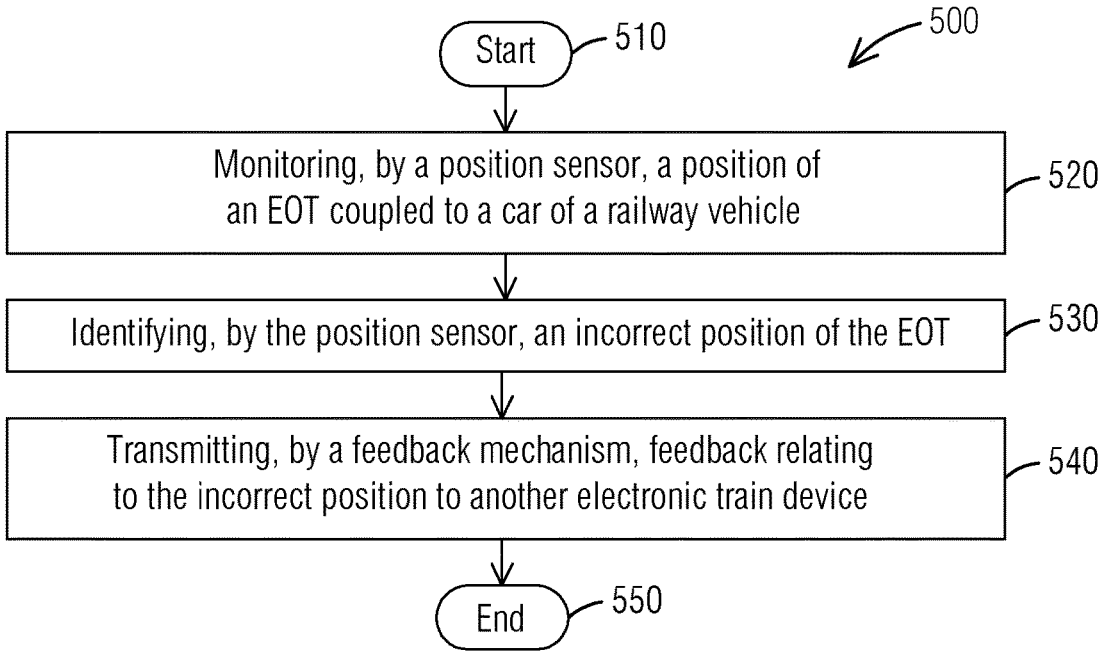
FIG. 5 illustrates a flow chart of a method for monitoring mounting integrity of an EOT in accordance with an exemplary embodiment of the present disclosures.

FIG. 5 illustrates a flow chart of a method for monitoring mounting integrity of an EOT in accordance with an exemplary embodiment of the present disclosures. For example, method 500 may be performed utilizing an EOT 200 and/or a system 400 as described with reference to FIG. 2, FIG. 3 and FIG. 4.

While the method 500 is described as a series of acts or steps that are performed in a sequence, it is to be understood that the method 500 may not be limited by the order of the sequence. For instance, unless stated otherwise, some acts may occur in a different order than what is described herein. In addition, in some cases, an act may occur concurrently with another act. Furthermore, in some instances, not all acts may be required to implement a methodology described herein.

The method 500 starts at 510 and comprises an act 520 of monitoring, by a position sensor, a position of an EOT coupled to a car of a railway vehicle. The position sensor is integrated into the EOT 200. Act 530 comprises identifying an incorrect position of the EOT 200, and transmitting, by a feedback mechanism of the EOT, feedback relating to the incorrect position to another electronic train device, se act 540. At 550, the method may end. The position comprises vertical alignment and orientation (with respect to angles) of the EOT 200.

In an embodiment, the method 500 may further comprise monitoring, by an imaging device, a brake pipe connection between a brake hose of the railway vehicle and a hose of the EOT, the imaging device being integrated into the EOT, identifying a faulty brake pipe connection, and transmitting, by the feedback mechanism, feedback relating to the faulty brake pipe connection to the other electronic train device. The feedback is transmitted, directly or indirectly via a remote station, e. g. remote server, to the HOT of the railway vehicle.

The position of the EOT 200 is monitored during installation of the EOT 200 and/or during operation of the railway vehicle. Similarly, the brake pipe connection is monitored during installation of the EOT 200 and/or operation of the railway vehicle.

The described EOT, monitoring and communications system and corresponding method provide significant benefits by automating an EOT alignment process during installation, and providing constant integrity checking of the connection status between the EOT and the railway vehicle.

The invention claimed is:

1. An end of train device (EOT) for a railway vehicle comprising:

a mounting unit for installing the EOT on a car of a railway vehicle, a position sensor configured to detect vertical alignment and orientation during an installation of the EOT, a feedback mechanism configured to provide feedback during the installation with respect to the vertical alignment and orientation, an imaging device comprising a camera configured to monitor a brake pipe connection between a brake hose of the railway vehicle and a hose of the EOT, wherein the imaging device comprising the camera is coupled to the feedback mechanism configured to provide feedback with respect to the brake pipe connection, and wherein the feedback mechanism is configured to transmit the feedback with respect to the vertical alignment, the orientation and the brake pipe connection to a head of train device (HOT).

2. The EOT of claim 1, wherein the feedback mechanism is configured to provide visual feedback and/or audio feedback.

3. The EOT of claim 2, wherein the feedback mechanism is connected to a display for displaying the visual feedback, the display being integrated into the EOT.

4. The EOT of claim 2, wherein the feedback mechanism is connected to an audio output device for providing the audio feedback, the audio output device being integrated into the EOT.

5. The EOT of claim 1, wherein the feedback mechanism comprises one or more vibration units configured to vibrate in response to an incorrect alignment and/or incorrect orientation.

6. The EOT of claim 1, wherein the position sensor is configured to monitor attitude including vertical alignment and orientation of the EOT while the railway vehicle is travelling.

7. The EOT of claim 1, wherein the position sensor is selected from an accelerometer, gyroscope, compass, a global positioning system (GPS) receiver or a global navigation satellite system (GNSS) receiver.

8. A monitoring and communications system comprising:

an end of train device (EOT) coupled to a car of a railway vehicle, a head of train device (HOT), a communications network interfacing with EOT and HOT, wherein the EOT comprises a position sensor configured to detect vertical alignment and orientation of the EOT, and a feedback mechanism configured to provide feedback with respect to the vertical alignment and orientation, and wherein the EOT is configured to transmit the feedback with respect to the vertical alignment and orientation to the HOT, wherein the EOT further comprises an imaging device comprising a camera for monitoring a brake pipe connection between a brake hose of the railway vehicle and a hose of the EOT, and wherein the imaging device comprising the camera is coupled to the feedback mechanism configured to provide feedback with respect to the brake pipe connection to the HOT.

9. The communication system of claim 8, wherein the EOT is configured to transmit the feedback directly to the HOT via a radio-based telemetry link.

10. The communication system of claim 8, wherein the EOT is configured to transmit the feedback indirectly to the HOT via a remote server or a remote base station.

11. The communication system of claim 8, wherein the EOT is configured to transmit the feedback including alignment or connection information to a remote server or a remote base station, and wherein the remote server or base station is configured to broadcast the feedback of the EOT to one or more other railway vehicles.

12. The method of claim 11, wherein the position comprises vertical alignment and orientation of the EOT.

13. The method of claim 11, wherein the position and the brake pipe connection of the EOT are monitored during installation of the EOT and/or during operation of the railway vehicle.

14. The method of claim 11, wherein the feedback is transmitted to a head of train device (HOT) or another EOT.

15. A method of monitoring mounting integrity of an end of train device (EOT), the method comprising:

monitoring, by a position sensor, a position of an EOT coupled to a car of a railway vehicle, the position sensor being integrated into the EOT, identifying, by the position sensor, an incorrect position of the EOT, and transmitting, by a feedback mechanism, feedback relating to the incorrect position to another electronic train device, monitoring, by an imaging device comprising a camera, a brake pipe connection between a brake hose of the railway vehicle and a hose of the EOT, the imaging device being integrated into the EOT, identifying a faulty brake pipe connection, and transmitting, by the feedback mechanism, feedback relating to the faulty brake pipe connection to the other electronic train device.

* * * * *